US012467256B2

(12) United States Patent
Hooper

(10) Patent No.: US 12,467,256 B2
(45) Date of Patent: Nov. 11, 2025

(54) FRAME AND INSULATION PANEL SYSTEM

(71) Applicant: Insu-Built Structures Inc., Abbotsford (CA)

(72) Inventor: Lawrie Hooper, Abbotsford (CA)

(73) Assignee: Insu-Built Structures Inc., Abbotsford (CA)

( * ) Notice: Subject to any disclaimer, the term of this patent is extended or adjusted under 35 U.S.C. 154(b) by 156 days.

(21) Appl. No.: 17/814,907

(22) Filed: Jul. 26, 2022

(65) Prior Publication Data

US 2023/0059615 A1 Feb. 23, 2023

(30) Foreign Application Priority Data

Jul. 26, 2021 (CA) ..... CA 3126079

(51) Int. Cl.

| | |
|---|---|
| ***E04B 2/86*** | (2006.01) |
| ***E04G 11/18*** | (2006.01) |
| ***E04G 17/04*** | (2006.01) |
| ***E04G 17/06*** | (2006.01) |

(52) U.S. Cl.

CPC ..... *E04B 2/8652* (2013.01); *E04G 17/06* (2013.01); *E04B 2/8635* (2013.01); *E04B 2103/02* (2013.01); *E04G 11/18* (2013.01); *E04G 17/047* (2013.01); *E04G 2017/0646* (2013.01)

(58) Field of Classification Search

CPC ..... E04B 2/8652; E04B 2103/02

See application file for complete search history.

(56) References Cited

U.S. PATENT DOCUMENTS

| | | | | |
|---|---|---|---|---|
| 6,125,608 | A * | 10/2000 | Charlson | F16B 33/02 52/847 |
| 6,698,710 | B1 * | 3/2004 | VanderWerf | E04B 2/8652 52/294 |
| 7,654,052 | B2 * | 2/2010 | Cooper | E04B 2/8617 52/309.11 |
| 7,870,702 | B2 * | 1/2011 | McKay | E04C 5/20 52/681 |
| 7,908,809 | B2 * | 3/2011 | Meier | E04F 21/05 52/319 |
| 2011/0057090 | A1 * | 3/2011 | Spude | E04G 11/06 249/19 |
| 2019/0048553 | A1 * | 2/2019 | Flint | E01D 21/00 |
| 2020/0040581 | A1 * | 2/2020 | Paulger | E04C 5/168 |

FOREIGN PATENT DOCUMENTS

| | | | | |
|---|---|---|---|---|
| WO | WO-2007028006 A2 * | 3/2007 | ..... | E04B 2/8641 |

* cited by examiner

*Primary Examiner* — Omar F Hijaz
(74) *Attorney, Agent, or Firm* — Stoel Rives LLP

(57) ABSTRACT

A system and method for positioning and retaining an internal rebar skeleton for a concrete wall prior to pouring uses spaced apart vertical frame members having horizontal structures onto which horizontally oriented rebar can be laid and modular rebar retainers for positioning vertically oriented rebar in relation to the horizontally oriented rebar. The frame members may also include retention structures allowing for the insertion of spaced-apart rows of insulated panels to form an internal cavity into which concrete may be poured. External cladding is affixed to an external flange or sheath on the frame members with a thickness that creates a desired air gap between the external cladding and insulated panels. Frame members may also be laid horizontally across the top of a vertical layer of panels to form a base for a successive layer of vertical frame members and panels.

8 Claims, 11 Drawing Sheets

FRAME AND INSULATION PANEL SYSTEM

FIELD OF THE INVENTION

This invention relates to building construction. In particular, this invention relates to improvements to insulated concrete forms for building wall construction.

BACKGROUND OF THE INVENTION

A popular material for construction of low-rise buildings, and becoming increasingly popular for residential construction, is concrete. Particularly in larger and taller buildings constructed from concrete, the concrete must incorporate a skeleton of reinforcing bar or "rebar" to resist the tensile and bending forces developed in the wall. The individual horizontal and vertical rebar must be assembled so that they are correctly distributed in the concrete form and retain that form while the concrete is poured around the rebar and solidifies. Conventionally, this is done through rebar-tying, that is, tying adjacent perpendicular rebar together with wire. Rebar-tying is an extremely time consuming and labour-intensive process. It would be advantageous if a modular positioning system for a wall's rebar skeleton could be provided so as to obviate the need for tying.

In a concrete building, the concrete is generally supplied as a slurry which is poured into forms and allowed to solidify. While the forms are often reusable, there is a considerable amount of time and labour expended to erect and remove the forms before and after the concrete is poured. It would be far more efficient if the forms could be left in place, and preferably comprised components necessary to the completed wall, such as insulation.

Insulated concrete form (ICF) wall systems wherein the forms comprise part of the completed wall are known. However, such systems often use highly specific and customized components, including the insulation panels. It would be advantageous if the ICF wall system could use at least some generic and widely available components.

After construction of a wall's substructure is complete, a weather barrier must be applied on the exterior surface of the wall before the exterior cladding may be installed. Weather barriers generally comprise a sheet of material, often a polymer, that resists bulk fluid infiltration of the wall but allows vapour to be released from the wall. For optimal performance, the weather barrier should be continuous and unbroken across the exterior of the wall substructure.

Commonly, a weather barrier is supplied as a roll of material that is wrapped around the exterior of the wall substructure. This is also a time-consuming and labor-intensive process in building construction.

Additionally, exterior cladding cannot be affixed directly to the weather barrier; most building codes require an air gap between the cladding and the weather barrier so that bulk fluid that manages to infiltrate the cladding may drain to the ground instead of being trapped against the weather barrier. Commonly, flashing strips are fastened to the weather barrier by nails or screws, and the cladding is then affixed to the flashing strips. The process of applying the flashing strips is also very time-consuming and labour-intensive. Further, the flashing fasteners perforate the weather barrier and allow bulk fluid to infiltrate the weather barrier. It would be advantageous to provide for a method of affixing exterior cladding in a manner that does not necessitate additional labour or compromise the weather barrier.

Insulated concrete form systems have a fixed height. Accordingly, when constructing walls taller than this fixed height, multiple layers of insulated concrete forms must be used. Existing insulated concrete form systems generally require specialized components to attach an upper layer of insulated concrete forms to the lower layer. It would be advantageous if a minimal number of different types of components could be used in constructing taller walls.

It is therefore an object of this invention to provide a modular positioning system for a wall's internal rebar skeleton.

It is another further object of the invention to provide an ICF system that incorporates an exterior weather barrier.

It is yet another further object of the invention to provide an ICF system that allows exterior cladding to be applied in a manner that creates an air gap dictated by building codes while also avoiding compromising the underlying weather barrier.

It is still another further object of the invention to provide an ICF system that can be used in the construction of taller walls without the need for specialized components between vertical layers of forms.

These and other objects will be better understood by reference to this application as a whole. Not all of the objects are necessarily met by all embodiments of the invention described below or by the invention defined by each of the claims.

SUMMARY OF THE INVENTION

In this specification relative positions of the components refer to their position in respect of a notional building constructed using the invention. "Longitudinal" refers to the horizontal direction aligned with the length of a wall. "Transverse" refers to the horizontal direction passing perpendicular through the thickness of the wall. "Inner" and "outer" are relative positions along the transverse axis towards the interior and exterior, respectively, of the notional building.

In one aspect, the invention comprises a rebar trestle system for positioning horizontal and vertical rebar making up the internal skeleton of a concrete wall. The rebar trestle system comprises a plurality of longitudinally spaced apart vertical frame members. Each frame member comprises an interior post, an exterior post, and a plurality of substantially horizontal trays extending transversely between the interior post and exterior post. Each tray comprises a plurality of slots formed in an upper edge of the tray. Each tray further comprises a plurality of apertures formed through the tray. Preferably, there will be four trays in each frame member, and three slots and two apertures in each tray, although these numbers will vary depending upon the size, strength and durability of the desired finished wall. The rebar trestle system preferably further comprises a plurality of rebar retaining members, each rebar retaining member itself retained by one of the apertures. Each rebar retaining member preferably comprises an elastically deformable split pin insertable into an aperture, a rebar receiving portion, and an arm extending between the split pin and the rebar receiving portion. The split pin securely snap fits with the aperture. Horizontal rebar may be laid into collinear slots of longitudinally adjacent trays and vertical rebar may be threaded through vertically adjacent rebar receiving portions, thereby providing a correctly-positioned rebar skeleton prior to pouring concrete to finish the wall. The rebar trestle system will form part of the finished wall after pouring.

In another aspect, the invention comprises an improved ICF system for construction of cast-in-place concrete walls, wherein the forms remain in place after casting as a component of the finished wall. The ICF system comprises a plurality of longitudinally spaced-apart vertical form members. Each form member comprises an inner post, an outer post, and a plurality of vertically spaced-apart transverse interstitial webs connecting the inner post to the outer post.

At least some of the interstitial webs of each of the form members further comprise one or more troughs formed in an upper edge of the interstitial web. Rebar may then be laid horizontally in the troughs of interstitial webs of adjacent frame members to provide additional strength. At least the uppermost and lowermost interstitial webs preferably each comprise a plurality of ports formed longitudinally through the interstitial web. The ICF system then preferably further comprises a plurality of rebar retainers, each rebar retainer inserted into a port.

Vertical rebar can be threaded through receiving portions (such as rings) of vertically adjacent rebar retainers, thereby holding the vertical rebar upright and in position in the interstitial cavity. The troughs and rebar retainers support a grid of rebar that forms a skeleton for the concrete once cast, giving additional strength and durability to the wall.

The inner and outer posts both each comprise an inner flange, an outer flange, and a post web connecting the inner flange to the outer flange. The inner flange, outer flange, and post web together define two adjacent vertical channels that open in longitudinally opposite directions. The ICF system further comprises a plurality of inner panels that each insert into the channels of adjacent inner posts and extend longitudinally between adjacent form members, and a plurality of outer posts that likewise each insert into channels of adjacent outer posts and extend longitudinally between adjacent form members. The form members thus transversely space apart the resultant rows of inner panels and outer panels to create an interstitial cavity that is filled with concrete to construct the wall. The panels will preferably comprise an insulating material to improve the thermal efficiency of the wall.

In another aspect, the plurality of outer panels each further comprise a weather resistant membrane, such as TYVEK HOMEWRAP®, applied to the outer surface of each outer panel. A plurality of sheathes are provided, each sheath sliding over the exterior flange of an outer stud. The sheathes may be produced in a variety of thicknesses, such that the combined thickness of each sheath and exterior flange is preferably equivalent to the air gap distance mandated by the applicable building codes for the jurisdiction in which the invention is deployed. Exterior cladding may then be fixed directly to the sheath and flange for completion of the building without compromising the weather resistant membranes.

In another aspect, the components of the invention can be used to construct multiple-layer walls without the need for additional components. After constructing a base layer of wall, the inner and outer insulating panels may protrude above the top of the form members of the base layer. Additional form members are then laid horizontally along the top of the base layer wall such that the protruding insulation panels insert into the downward-facing channels of the horizontally laid form members. A second layer of insulating panels alternating with vertical form members may be inserted into the upward-facing channels of the horizontally laid form members to create an insulated concrete form for the next vertical section of wall.

In another embodiment, the invention is a construction system for positioning reinforcing bar comprising a plurality of longitudinally spaced apart vertical frame members and a plurality of rebar retaining members. Each of the frame members has an interior stud, an exterior stud transversely spaced apart from the interior stud, and one or more trays extending transversely between the interior stud and the exterior stud. Each of the one or more trays has one or more slots formed in an upper side of the tray and one or more apertures formed through the tray. Each of the plurality of rebar retaining members is retainable by one of the apertures.

In another aspect, each of the plurality of rebar retaining members comprises an elastically deformable clip insertable into one of the apertures, a rebar receiving portion, and an arm connecting the rebar receiving portion to the elastically deformable clip.

In another aspect, the one or more trays is four trays.

In another aspect, the one or more slots is three slots.

In another aspect, the one or more apertures is two apertures.

In another embodiment, the invention is a method of erecting a reinforcing bar skeleton for a concrete wall. The method comprises providing a construction system for positioning reinforcing bar, providing a plurality of horizontally oriented reinforcing bar, and providing a plurality of vertically oriented reinforcing bar. The construction system for positioning reinforcing bar comprises a plurality of longitudinally spaced apart vertical frame members. Each of the frame members comprises an interior post, an exterior post transversely spaced apart from the interior post, a plurality of trays, and a plurality of rebar retaining members. The trays are vertically arrayed and extend transversely between the interior post and the exterior post. Each of the trays comprises a plurality of slots formed in an upper side of the tray and a plurality of apertures formed through the tray. Each of the rebar retaining members is retainable by one or the apertures. Each of the plurality of horizontally oriented reinforcing bar is positioned in and extends between respective slots of adjacent frame members. Each of the plurality of horizontally oriented reinforcing bar is inserted through respective vertically aligned rebar retaining members.

In another aspect, the invention is a concrete form system for constructing a wall. The system comprises a plurality of longitudinally spaced-apart form members. Each of the form members comprises a vertically upstanding inner post, a vertically upstanding outer post, a plurality of interstitial webs arrayed vertically and extending transversely between the inner post and the outer post, a plurality of rebar retaining members, a plurality of outer panels, and a plurality of inner panels. The outer post is transversely opposed to the inner post. Each of the plurality of interstitial webs comprises a plurality of troughs formed in an upper edge of the interstitial web and a plurality of ports formed through the interstitial web. The plurality of rebar retaining members are insertable into the plurality of ports. Each of the plurality of outer panels is retained between respective outer posts of adjacent form members. Each of the plurality of inner panels is retained between respective inner posts of adjacent form members.

In another aspect, each of the outer posts comprises an interstitial flange, an exterior flange, and an outer post web extending between the interstitial flange and the exterior flange.

In another aspect, the interstitial flange, the exterior flange, and the outer post web form first and second vertical channels.

In another aspect, each of the plurality of outer panels is retained by a respective first vertical channel and a respective second vertical channel of adjacent form members.

In another aspect, the thickness of the exterior flange corresponds to an air gap distance between the plurality of outer panels and an exterior cladding affixed to the exterior flange.

In another aspect, the system further comprises a plurality of sheathes each adapted to envelop the exterior flange of one frame member of the plurality of frame members.

In another aspect, the combined thickness of one of the plurality of sheathes and the exterior flange of one frame member of the plurality of frame members corresponds to an air gap distance between the plurality of outer panels and an exterior cladding affixed to the one of the plurality of sheathes.

In another aspect, each of the outer panels further comprises an exterior layer. In another aspect, the exterior lawyer is a weather barrier.

In another aspect, each of the inner posts comprises an interstitial flange, an interior flange, and an inner post web extending between the interstitial flange and the interior flange.

In another aspect, the interstitial flange, the interior flange, and the inner post web form first and second vertical channels.

In another aspect, each of the plurality of inner panels is retained by a respective first vertical channel and a respective second vertical channel of adjacent form members.

In another aspect, each of the rebar retaining members comprises a retention clip insertable into the aperture, an arm, and a rebar receiving portion.

In another aspect, the arm comprises an angle bracket.

In another aspect, the rebar receiving portion comprises a ring.

In another embodiment, the invention is a method of constructing a wall. A form system is provided comprising a plurality of form members, a plurality of rebar retaining members, a plurality of outer panels, and a plurality of inner panels. Each of the form members comprises an inner post, an outer post spaced apart transversely from the inner post, and a plurality of spaced apart interstitial webs extending transversely between the inner post and the outer post. Each of the interstitial webs comprise a plurality of slots formed in an edge of the interstitial web and a plurality of apertures formed through the interstitial web. The form members are erected vertically along a perimeter of the wall to be constructed so that each of the form members is spaced apart longitudinally from respective adjacent form members. One of the plurality of rebar retaining members is inserted into each aperture of the plurality of apertures of the plurality of interstitial webs of the plurality of form members. A plurality of horizontal reinforcing bars is provided and the plurality of horizontal reinforcing bars are inserted to extend between respective slots of adjacent form members. A plurality of vertical reinforcing bars is provided and each of the vertical reinforcing bars is inserted through vertically adjacent rebar retaining members of each of the form members. Each of the outer panels is inserted between respective outer posts of adjacent form members. Each of the inner panels is inserted between respective inner posts of adjacent form members. Concrete is poured into an interstitial cavity formed between the plurality of outer panels and the plurality of inner panels.

In another aspect, the inner panels and the outer panels are taller than the form members.

In another aspect, the inner panels each comprise an inner top edge and an inner bottom edge and the outer panels each comprise an outer top edge and an outer bottom edge.

In another aspect, a second plurality of the form members is provided and laid horizontally so that the inner top edges of the plurality of inner panels insert into inner posts of the second plurality of the form members and the outer top edges of the plurality of the outer panels insert into outer posts of the second plurality of the form members. A third plurality of form members is provided and erected vertically and longitudinally spaced apart on the second plurality of form members. A second plurality of the outer panels is provided and each of the second plurality of the outer panels is inserted into respective outer posts of the second plurality of the form members and between respective outer posts of the third plurality of the form members. A second plurality of the inner panels is provided and each of the second plurality of the inner panels is inserted into respective inner posts of the second plurality of the form members and between respective inner posts of the third plurality of the form members.

In another aspect, the method is repeated to construct additional layers of wall.

In another aspect, each of the plurality of the form members, each of the second plurality of the form members, and each of the third plurality of the form members are identical in shape, size, and length.

The foregoing may cover only some of the aspects of the invention. Other and sometimes more particular aspects of the invention will be appreciated by reference to the following description of at least one preferred mode for carrying out the invention in terms of one or more examples. The following mode(s) for carrying out the invention are not a definition of the invention itself, but are only example(s) that embody the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1:
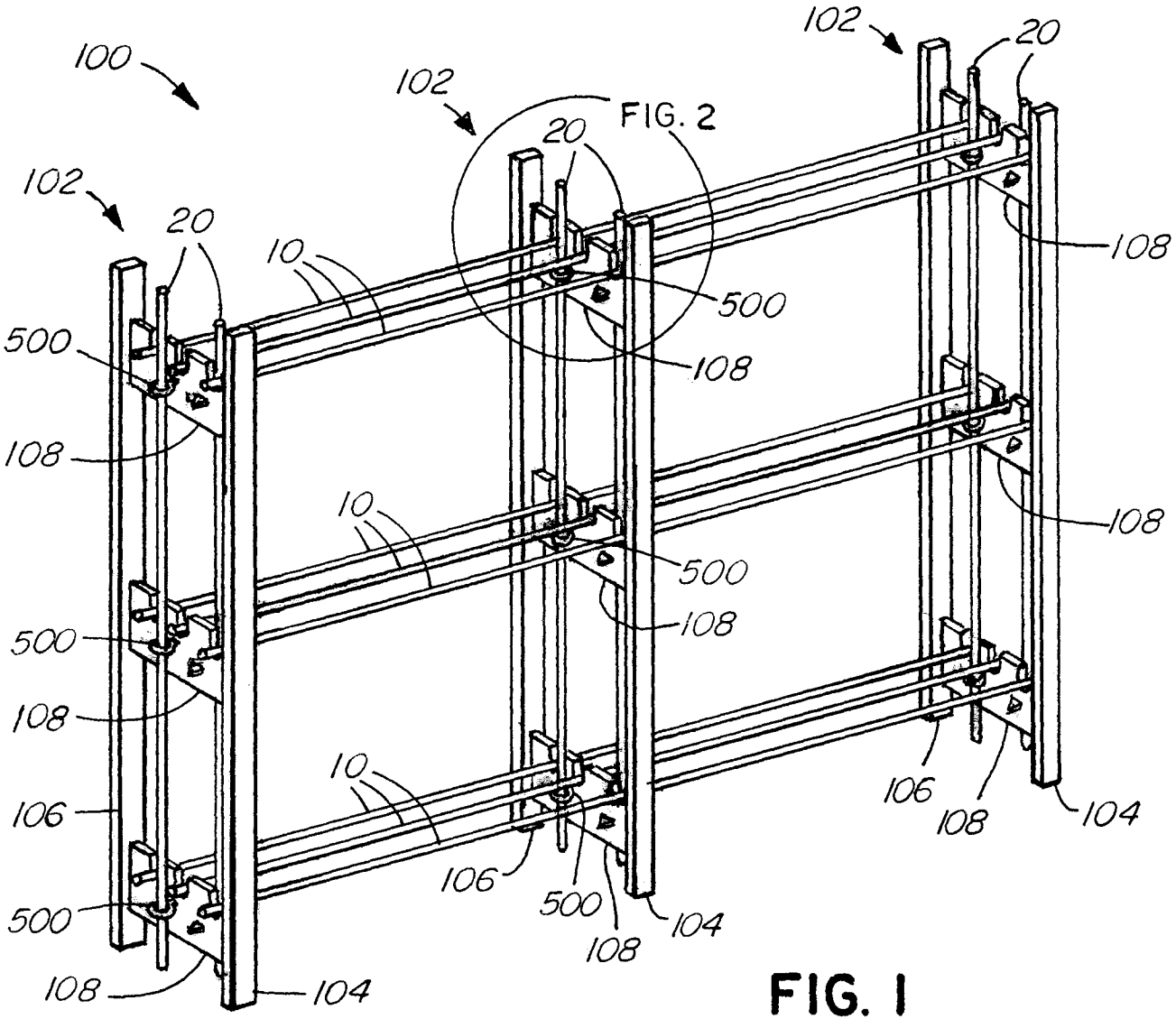
FIG. 1 is a perspective view according to a first embodiment of the invention of a section of rebar trestle with rebar installed.
Figure 2:
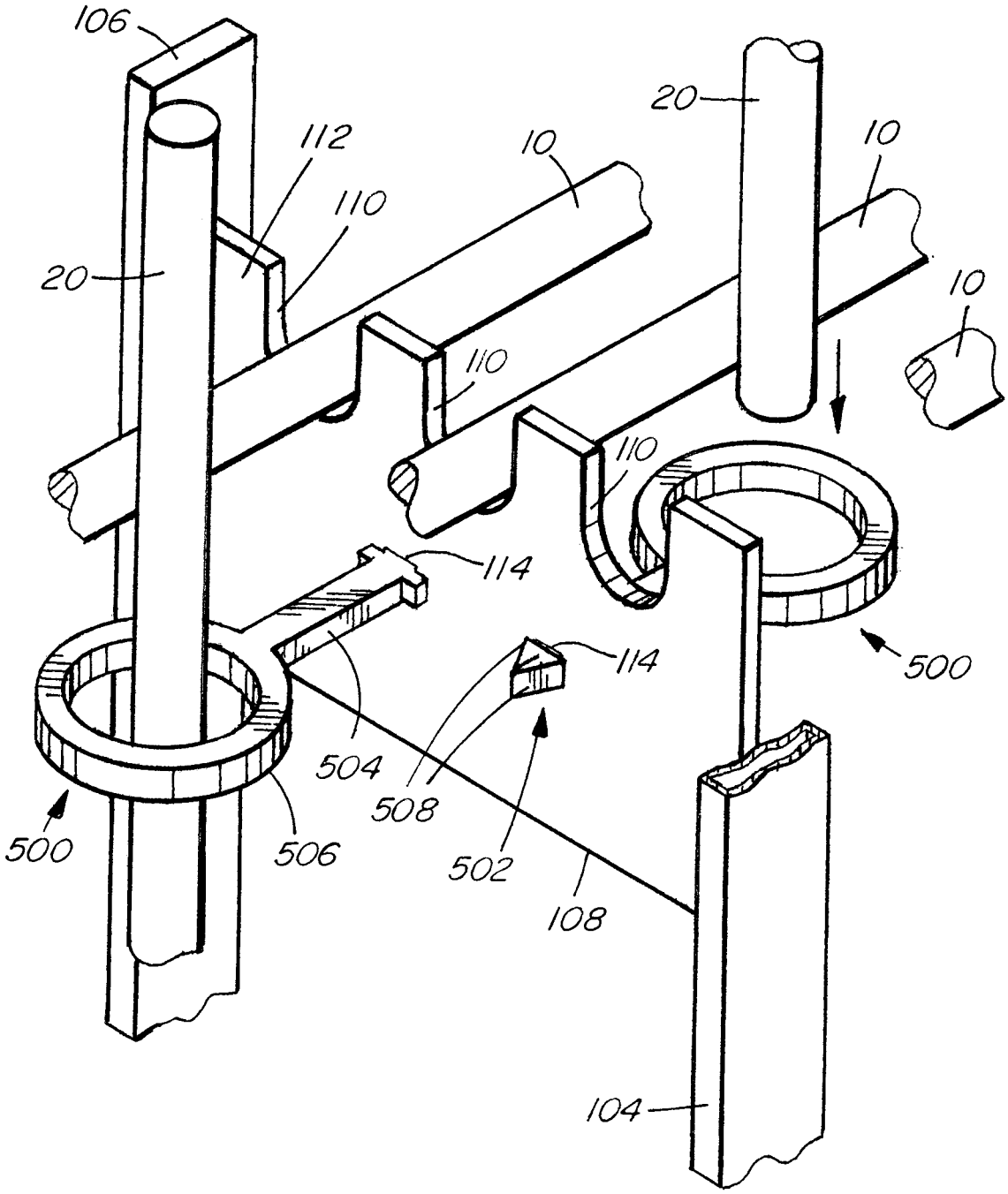
FIG. 2 is an enlarged partial perspective view of a rebar tray as indicated in FIG. 1 with portions of certain of the horizontal and vertical rebar removed for clarity.
Figure 3:
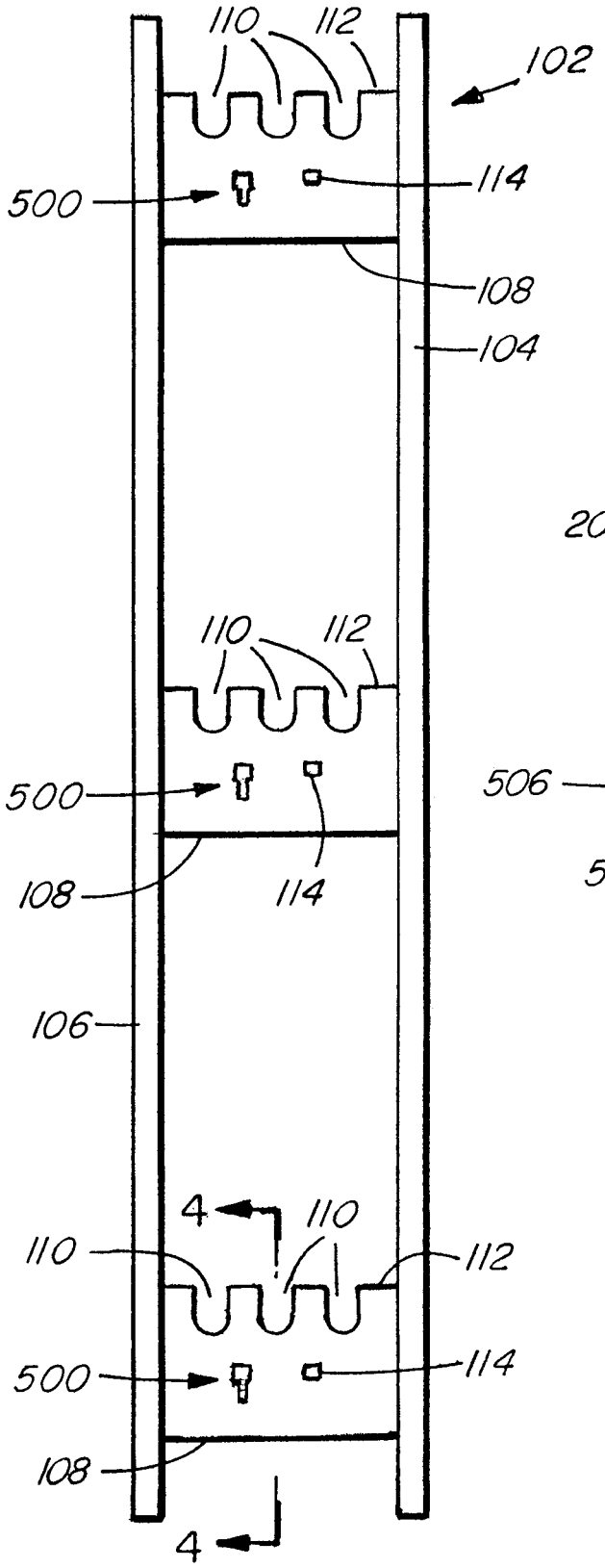
FIG. 3 is a front view of a vertical frame member of the rebar trestle of FIG. 1.

Referring to FIGS. 1-3, according to one embodiment of the invention a rebar trestle system 100 comprises a plurality of longitudinally spaced apart vertical frame members 102. The frame members 102 may be mounted to a base structure (not shown) which may include, but is not limited to, a foundation, a footing, or a stub wall. In some embodiments, an L-channel beam (not shown) may be fixed to the foundation to provide a straight line for aligning the frame members to the placement of the future wall. Form members 102 may be fixed to the L-channel beam or simply abutted against the L-channel beam.

Each vertical frame member 102 comprises an interior stud 104 and a transversely spaced apart exterior stud 106. A plurality of rebar trays 108 extend transversely between the interior stud 104 and the exterior stud 106. According to the exemplary embodiment shown by FIGS. 1 and 2, each frame member 102 comprises three rebar trays 108. Rebar trays 108 of each frame member 102 are preferably spaced apart vertically in an even fashion so that respective rebar trays 108 of adjacent frame members 102 are substantially aligned. The vertical frame members 102 are preferably manufactured from a rigid polymer material such as high-density polyethylene (HDPE), polyvinyl chloride (PVC), acrylonitrile butadiene styrene (ABS), or a similar material.

Each rebar tray 108 comprises a plurality of slots 110 formed in an upper side 112 of the rebar tray 108. According to the exemplary embodiment shown in FIGS. 1 and 2, there are three slots 110 in each rebar tray 108, although depending upon the required characteristics of the finished wall more or fewer slots 110 may be used. Additionally, each rebar tray 108 of a frame member 102 need not comprise the same number of slots 110, although aligned trays 108 of adjacent frame members 102 preferably contain the same number of slots 110.

Each rebar tray 108 also comprises one or more apertures 114 formed through the rebar tray 108. According to the exemplary embodiment shown in FIGS. 1 and 2, there are two apertures 114 in each rebar tray 108, although this number may vary depending upon the required characteristics of the finished wall. Each aperture 114 is preferably positioned transversely between adjacent slots 110 of each rebar tray 108. It will be appreciated that the size and shape of the 20) aperture could vary.

Referring to FIGS. 1-6, a rebar retaining member 500 is inserted into each aperture 114. The rebar retaining member 500 comprises a retention portion 502, a rebar receiving portion 506, and an arm 504 connecting the rebar receiving portion 506 to the retention portion 502. The receiving portion 506 may be in the shape of a ring as shown, although it will be appreciated that other shapes and forms are possible. The retention portion 502 preferably comprises elastically deformable hooks 508 that can be deflected inwards when inserted through the aperture 114 and then expand outward to hold the rebar retaining member 500 to the rebar tray 108. It will be appreciated that other forms of retention portion 502 for attachment of the rebar retaining member 500 to the rebar tray 108 are possible, including, but not limited to, threaded connections, bayonet-style connections, interference fit, and the like. When the rebar retaining member 500 is attached to the rebar tray 108, the rebar receiving portion 506 opens vertically. The arm 504 preferably further comprises an angle bracket 510 extending downwards from the arm 504 which supports and braces the rebar receiving portion 506 against the rebar tray 108. The arms 504 may be provided in a variety of lengths to account for different longitudinal spacing of vertical rebar 20 that may be necessary. The rebar retaining members 500 are also preferably manufactured from HDPE, PVC, ABS, or similar materials.

Figure 4:
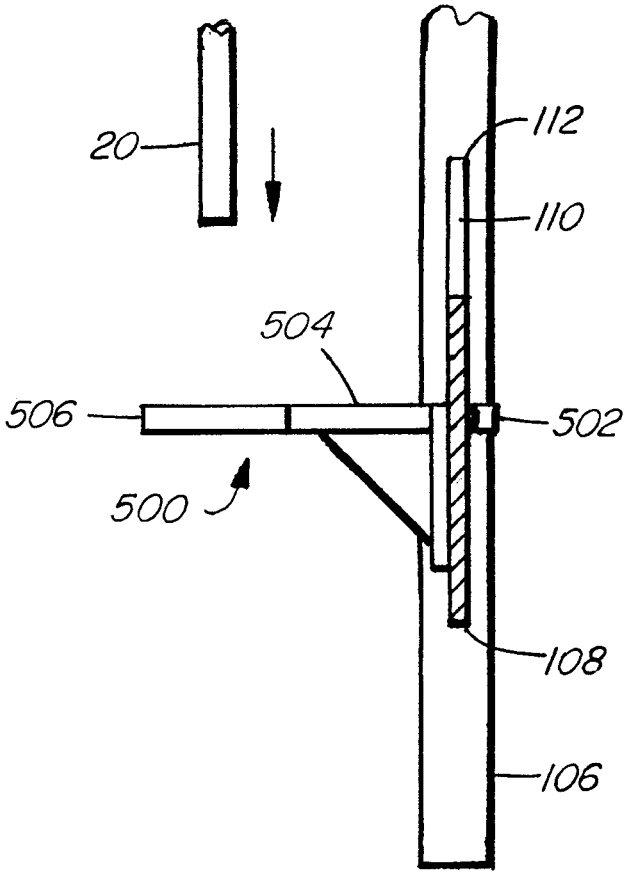
FIG. 4 is a partial section view of the vertical frame member of FIG. 3, taken along line 4-4 of FIG. 3.
Figure 5:
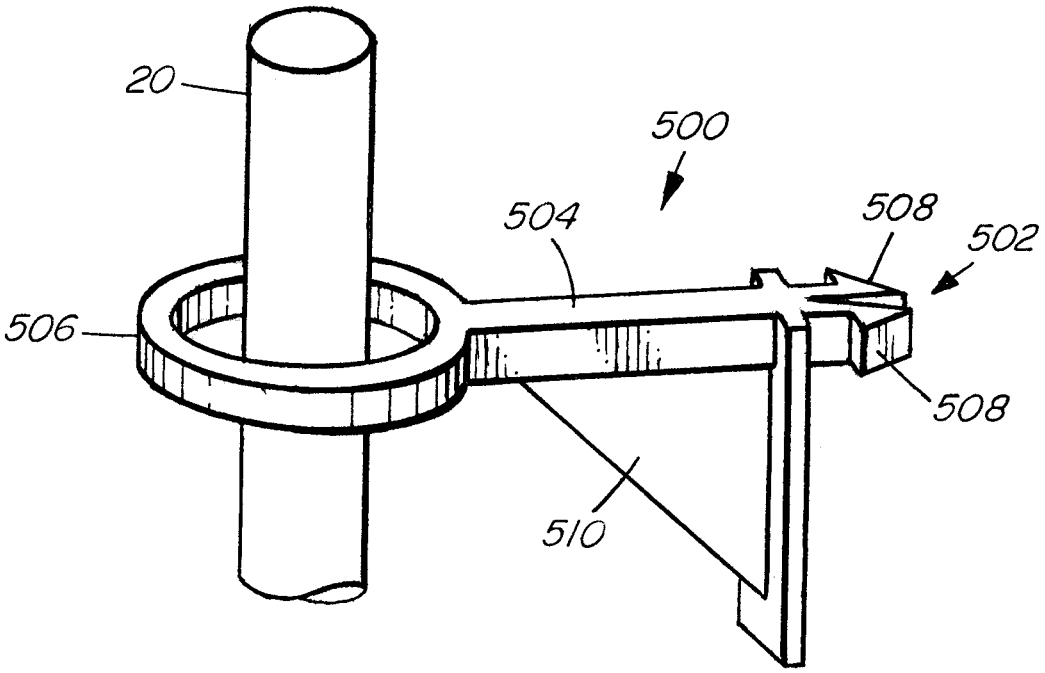
FIG. 5 is a perspective view of a rebar retaining member of the rebar trestle of FIG. 1.
Figure 6:
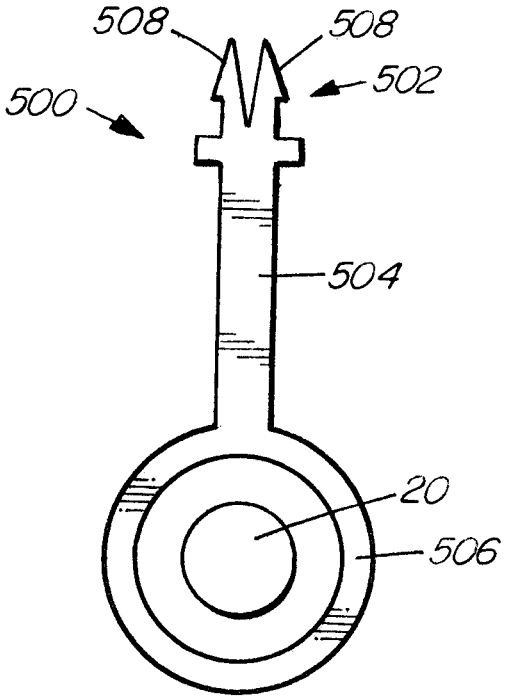
FIG. 6 is a top view of the rebar retaining member of FIG. 5.

Referring to FIGS. 1, 2 and 4, to assemble the rebar skeleton of a wall using the rebar trestle system 100, a plurality of frame members 102 are erected along the length of the intended completed wall. Rebar retaining members 500 are then inserted into each aperture 114. Horizontal rebar 10 can then be laid into aligned slots 110 of adjacent frame members 102. Vertical rebar 20 can likewise be threaded through vertically adjacent rebar retaining members 500. The trays 108 and rebar retaining members 500 thus combine to maintain the horizontal rebar 10 and vertical rebar 20 in the correct position relative to each other according to the strength and durability requirements of the finished wall. Once the horizontal rebar 10 and vertical rebar 20 are placed in position, concrete forms (not shown) can be erected around the rebar trestle system 100 and concrete can be poured around the rebar trestle system 100. The rebar trestle system 100 will then be embedded in the finished wall.

The rebar trestle system 100 may also be integrated with an insulated concrete form system to form a wall construction system 200. Referring to FIGS. 7-10, according to another embodiment of the invention, a wall construction system 200 comprises a plurality of form members 202, a plurality of outer panels 300, and a plurality of inner panels 400 assembled together as shown and as described in further detail below. Each of the plurality of form members 202 is sequentially erected along the longitudinal direction of the intended wall. Each form member 202 is longitudinally spaced apart from the adjacent form member 202 sufficiently to allow each outer panel 300 and inner panel 400 to be inserted longitudinally between adjacent form members 202. The outer panels 300 and inner panels 400 are retained in position by structures on the form members 202 described in further detail below.

Figure 7:
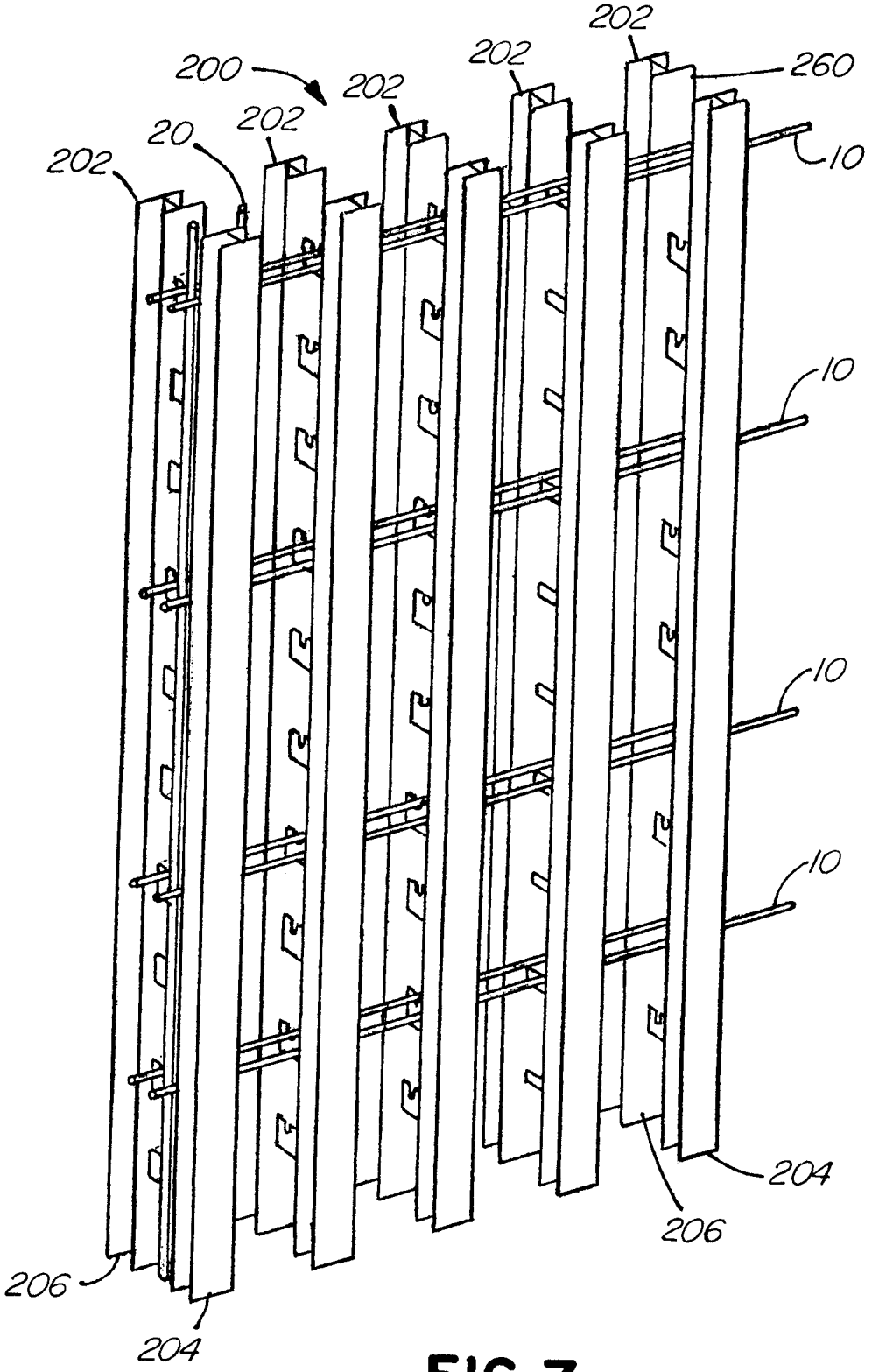
FIG. 7 is a perspective view according to a preferred embodiment of the invention of a section of wall construction system with rebar installed and inner and outer panels removed.
Figure 8:
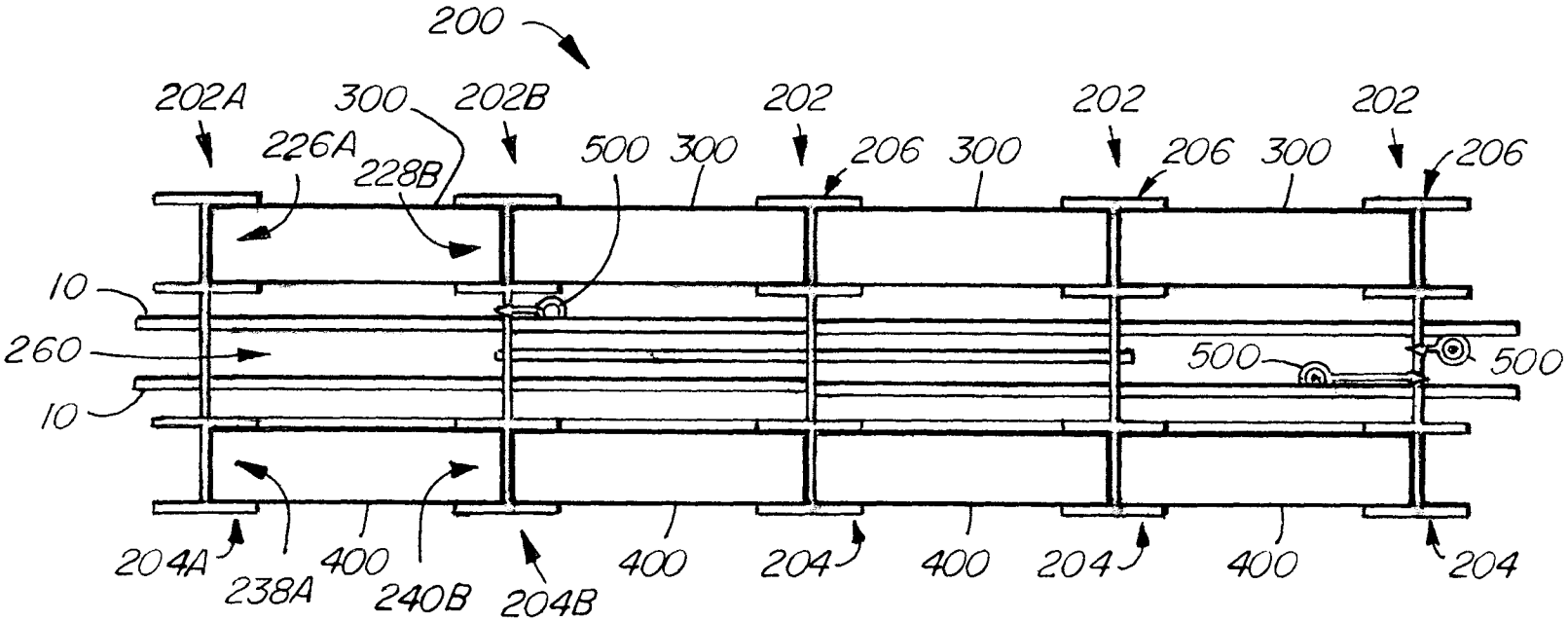
FIG. 8 is a top view of a section of wall construction according to the preferred embodiment of the invention with rebar and insulating panels installed.
Figure 9:
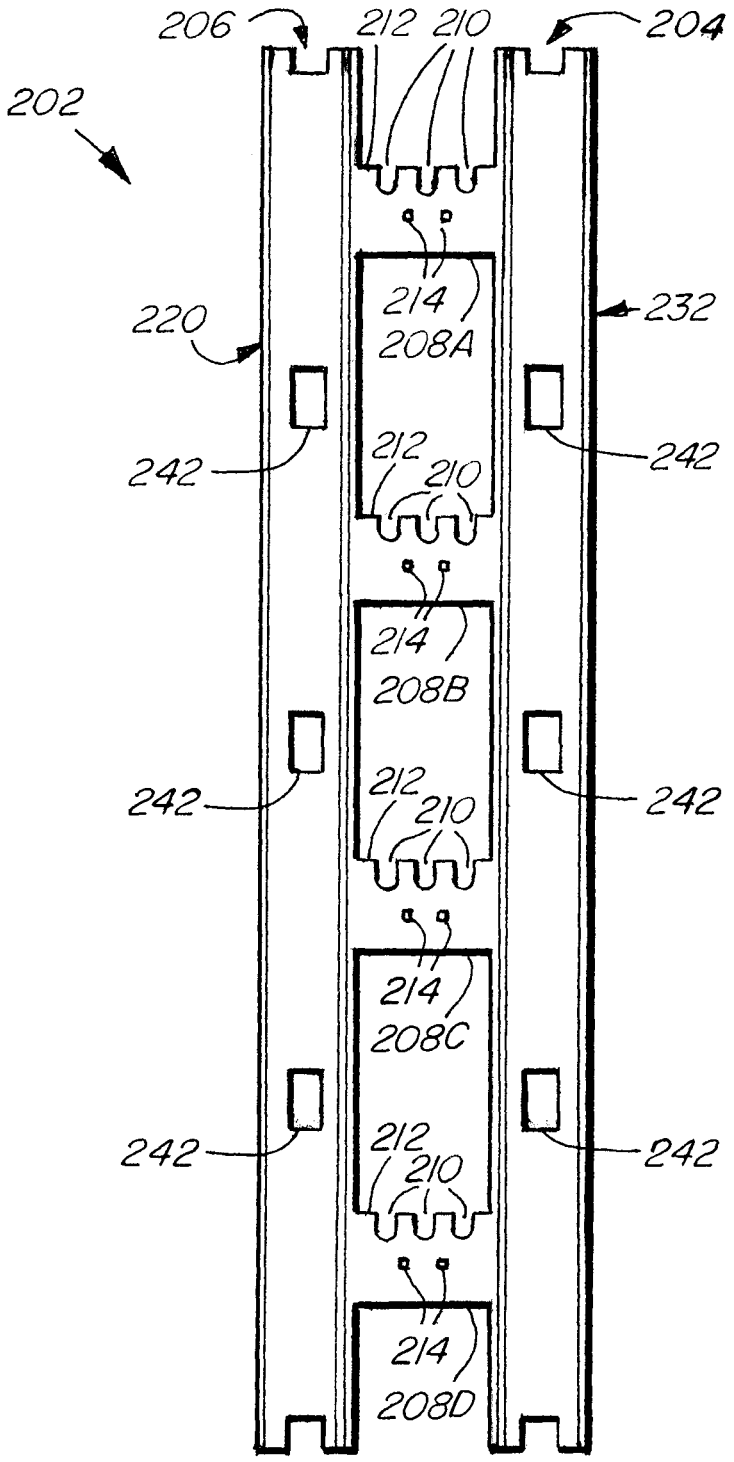
FIG. 9 is a front view of a form member of the wall construction system of FIG. 8.

Referring particularly to FIGS. 8 and 9, an individual form member 202 comprises an outer post 206 and a transversely spaced apart inner post 204. The outer post 206 is connected to the inner post 204 by a plurality of vertically spaced-apart interstitial webs 208. Preferably, there are four interstitial webs 208A, 208B, 208C, 208D as shown in FIG. 9, although it will be appreciated that there may be fewer, or more as shown in FIG. 7. Similar to the vertical frame members 102, each form member 202 is preferably manufactured from a rigid polymer such as HDPE, PVC, ABS, and the like.

Each interstitial web 208 further comprises a plurality of rebar troughs 210 formed in an upper edge 212 of the interstitial web 210. Horizontal reinforcing bar 10 can be laid into rebar troughs 210 of adjacent form members 202 to provide additional strength and durability to the finished wall. As shown in FIG. 8, there are preferably three rebar troughs 210 on each interstitial web 208 although the number of rebar troughs 210 may be modified as needed for the strength requirements of the finished building.

Each interstitial web 208 preferably further comprises a plurality of rebar retaining member ports 214 formed through the interstitial web 208. Preferably, each port 214 is transversely positioned between adjacent rebar slots 210. Rebar retaining members 500 may be inserted into each port 214 as described above in relation to the apertures 114 of the rebar trestle system 100.

Figure 10:
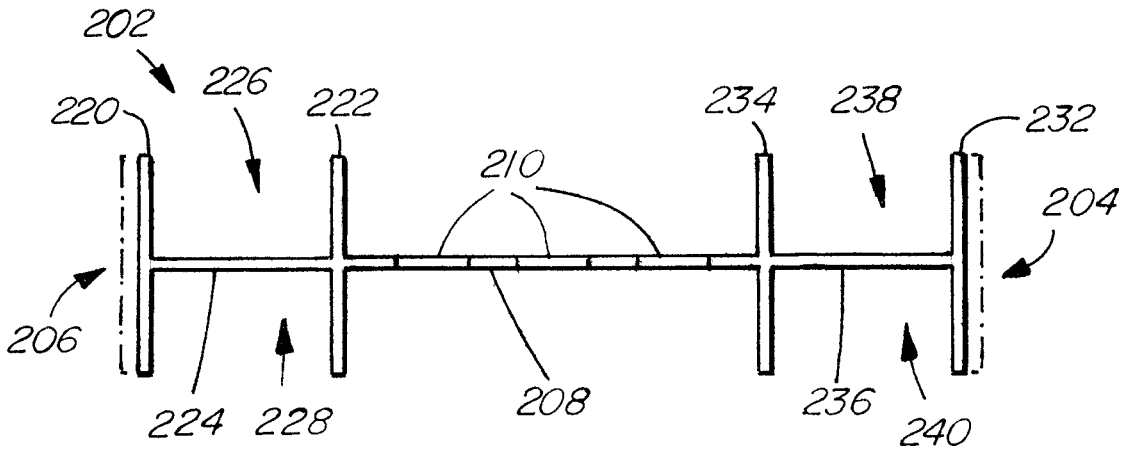
FIG. 10 is a top view of the form member of FIG. 9 with alternative flange thicknesses shown in broken outline.
Figure 11:
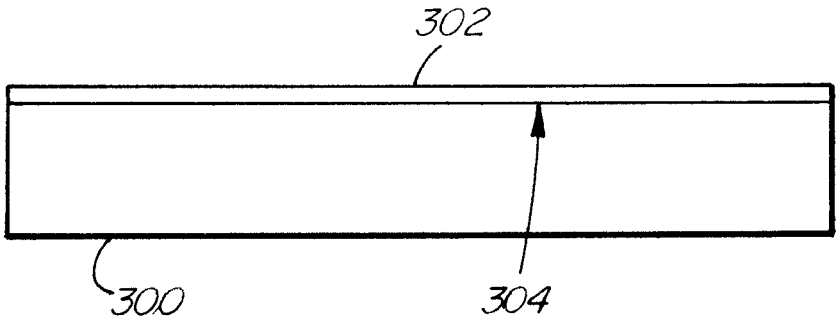
FIG. 11 is a top view of an outer panel of the wall construction system of FIG. 7 with a weather barrier attached.
Figure 12:
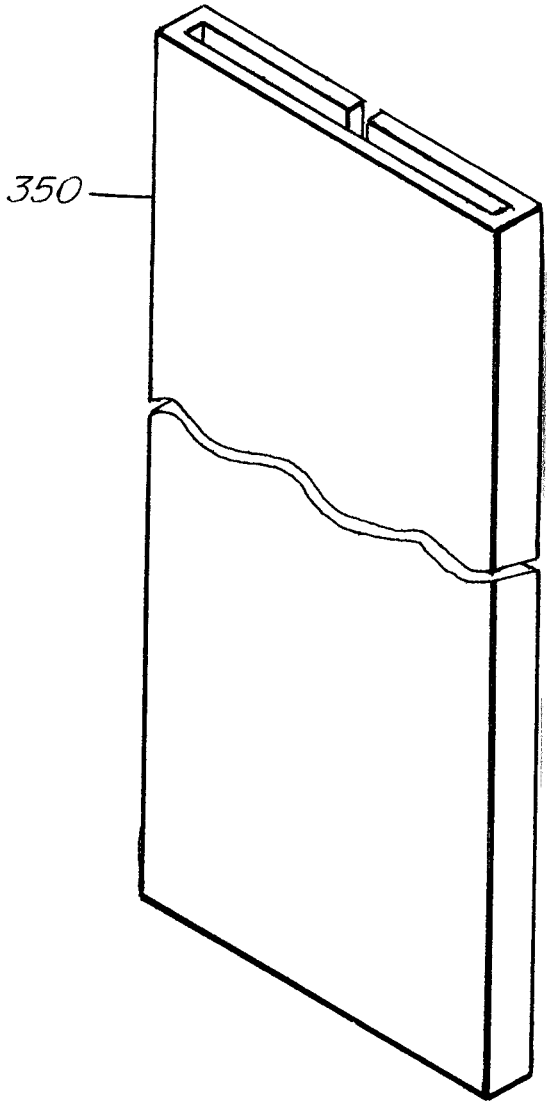
FIG. 12 is a perspective view of an exterior sheath for an exterior flange of the form member of FIGS. 9 and 10.
Figure 13:
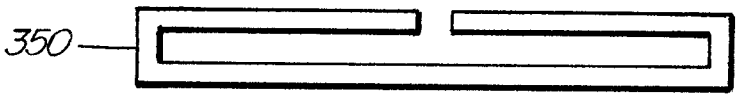
FIG. 13 is a top view of the exterior sheath of FIG. 12.

Referring particularly to FIGS. 9 and 10, the outer post 206 comprises an exterior flange 220 and a transversely spaced apart first interstitial flange 222. The exterior flange 220 and first interstitial flange 222 are connected by an outer post web 224. The exterior flange 220, first interstitial flange 222, and outer post web 224 together define a first channel 226 and second channel 228. The first channel 226 opens in a longitudinally opposed direction from the second channel 228 as shown.

Similarly, the inner post 204 comprises an interior flange 232 and a transversely spaced apart second interstitial flange 234. The interior flange 232 and second interstitial flange 234 are connected by an inner post web 236. The interior flange 232, second interstitial flange 234, and inner post web 236 together define a third channel 238 and fourth channel 240. The third channel 238 opens in a longitudinally opposed direction from the second channel 240 as shown. The outer post web 224 and inner post web 236 may optionally include pass-throughs 242 as shown in FIG. 9 for running plumbing or electrical conduit (not shown) along the completed wall.

Referring back to FIG. 8, an individual outer panel 300 is retained between adjacent frame members 202A, 202B by inserting the outer panel 300 into the first channel 226A of frame member 202A and the second channel 228B of frame member 202B. Similarly, an individual inner panel 400 is retained between adjacent frame members 202A, 202B by inserting the inner panel 400 into the third channel 238A of frame member 202A and the fourth channel 240B of frame member 202B. Preferably, the thickness of the outer and inner panels 300, 400 relative to the width of the first, second, third, and fourth channels 226, 228, 238, 240 is such that the panels snugly fit in the channels and are retained in place by friction alone. Alternatively, the first channel 226, second channel 228, third channel 238, and fourth channel 240 may further comprise retaining means to more securely retain the panels. These retaining means could be, but are not limited to, ridges, teeth, adhesives, or external fasteners such as nails or screws.

Preferably, the outer panels 300 and inner panels 400 are comprised of insulating materials. Commonly used insulating materials include, but are not limited to, expanded polystyrene, extruded polystyrene, and polyisocyanurate foams. Panels comprised of these materials are widely available in standard sizes, and the dimensions and spacing of the form members 202 are preferably designed to accommodate these standard panels. These materials are also at least somewhat compressible which contributes to a snug fit between the panels and the form members.

The outer panels 300 and inner panels 400, once installed between the form members 202, define an interstitial cavity 260 into which the concrete can be poured to form the completed wall. A snug fit between the panels and the form members is thus desirable to prevent leakage of the concrete slurry through the joints between the form members and the panels after pouring.

Figure 14:
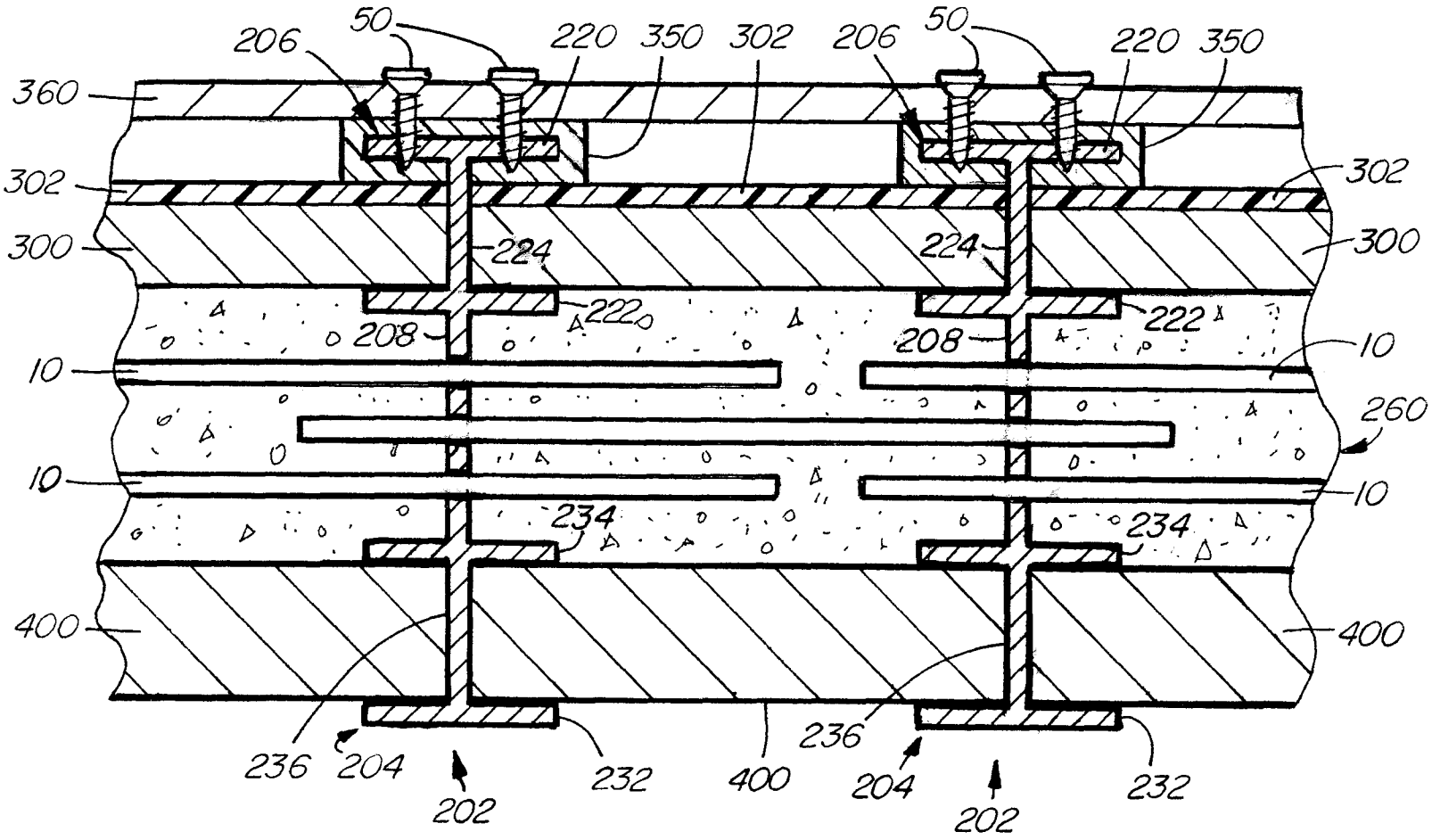
FIG. 14 is a top section view of a portion of wall completed using the wall construction system of FIG. 6, showing the air gap created by the exterior sheath between the exterior cladding and the exterior insulation panel.

Referring to FIGS. 11-14, the outer panels 300 preferably further comprise a weather barrier membrane 302 applied to an outer face 304 of the outer panel 300. Weather barrier membranes 302 are commercially available and include, but are not limited to products such as TYVEK BUILDING-WRAP®. The wall construction system 200 preferably further comprises a plurality of exterior sheathes 350, each of which are adapted to slide over an exterior flange 220. The dimensions of the exterior sheathes 350 are selected so that the combined thickness of the exterior flange 220 and exterior sheath 350 are equivalent to the air gap distance dictated by the local building codes in which the wall construction system 200 is used. Exterior cladding 360 can then be fastened to the exterior sheathes 350 and exterior flanges 220 by any fastening method known in the art, including, but not limited to, screws 50 as shown in FIG. 14. Perforation or other compromising of the weather barrier membrane 302 is thus avoided.

Referring back to FIG. 10, rather than using the exterior sheathes 350, the exterior flange 220 can simply be made thicker as shown in broken outline. That is, the thickness of the exterior flange 220 can be made to be equivalent to the air gap distance required by local building codes. This has the advantage of shorter construction times as it does not require an exterior sheath 350 to be attached to each exterior flange 220 prior to or during construction. However, it requires the wall construction system to be manufactured in multiple variants to account for different building codes in different jurisdictions. Nevertheless, the reduced time and cost at the construction site may be sufficient to offset the increased tooling costs associated with producing multiple variants. In some embodiments, the interior flange 232 may also be made thicker, as shown in broken outline in FIG. 10, to facilitate attachment interior wall finishing such as drywall panelling and the like (not shown) without perforating the interior panels 400.

Another embodiment of the invention is a method for constructing a wall using the wall construction system 200. First, the form members 202 are erected on a base structure (not shown). The form members 202 are secured to the base structure by suitable methods known in the art. Second, the vertical sheathes 350 are installed over exterior flanges 212. Third, the outer panels 300 and inner panels 400 are inserted longitudinally between adjacent form members 202 as described above. Fourth, rebar retainers 500 are installed in the interstitial webs 208 of the frame members 200 as necessary for the strength requirements of the final wall. Fifth, horizontal rebar 10 is laid into the rebar slots and vertical rebar 20 are threaded into the rebar retainers 500 as necessary. In some situations, it may be necessary, or simply easier, to perform the fourth and fifth steps before installing the outer panels 300 and inner panels 400. Finally, concrete is poured into the interstitial cavity 260 and allowed to cure. Exterior cladding 360 can then be affixed to the vertical sheathes 350 to complete the exterior of the wall, a section of which is shown in FIG. 14.

The rebar trestle system 100 and wall construction system 200 may be assembled with ease by builders and are expected to substantially reduce building time. With the use of outer panels 300 having an applied weather barrier membrane 302, building time is further reduced as builders will not need to apply housewrap to various exterior surfaces prior to affixing external cladding.

Smooth interior surfaces of the frame members 102 and the form members 202 and smooth surfaces of panels 300 and 400 allow for the smooth pouring of concrete and the reduction or elimination of voids that can often exist in prior art wall systems.

The rebar trestle system 100 and wall construction system 200 are also energy efficient compared to prior art wall systems which utilize metal or wood studs.

Figure 15:
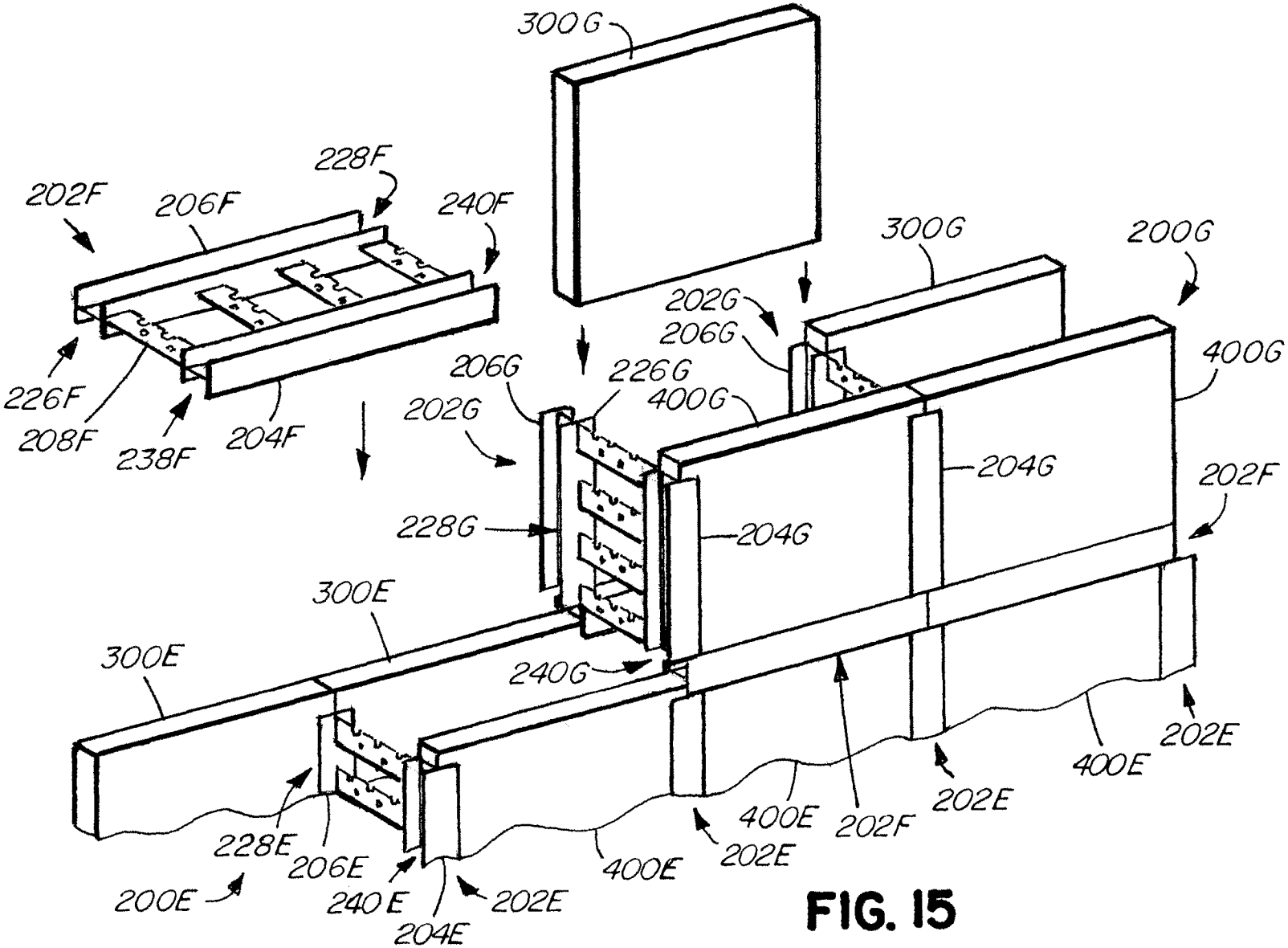
FIG. 15 is a perspective view of an embodiment according to the invention showing a partially complete multi-layer wall construction.

Whereas existing prior art ICF block systems are typically only used for the foundation of buildings, the wall construction system 200 can be utilized in multi-story buildings for walls up to at least six floors. Referring to FIG. 15, A first layer of wall construction system 200E is assembled as described above. Once the first layer of wall construction system 200E is in place, rebar may be installed and concrete poured for the first layer of wall. Alternatively, multiple layers of wall construction system 200E, 200G may be erected before the rebar is installed and the concrete poured as shown. In order to connect a second layer of wall construction system 200G to the first layer of wall construction 200E, horizontal form members 202F are laid over the tops of the outer panels 300E and inner panels 400E such that the outer panels 300E insert into the first channel 226F of the horizontal form members 202F and the inner panels 400E insert into the third channel 238F of the horizontal form members 202F. The second layer of wall construction system 200G is then erected by inserting the outer panels 300G into the second channel 228F of the horizontal form members 202F and inserting the inner panels 400G into the fourth channel 240F of the horizontal form members 202F. Form members 202G are interposed between successive sets of outer panels 300G and inner panels 400G. The form members 202G may rest on top of the horizontal form member 202F or may be fastened to the horizontal form member 202F. By alternating horizontal form members and successive wall construction systems, walls of the desired height can be constructed.

It will be recognized that inner panels 400 and outer panels 300 will be taller than the first layer form members 202E by half a flange length in order to connect the horizontal form members 202F. Similarly, subsequent upper layer form members, such as form members 202G, will be shorter than the base layer form members 202E. The form members may be provided to the construction site pre-sized to the correct lengths, or may be cut to length on site.

While outer panels 300E are shown as inserting into first channel 226F of horizontal form members 202F and inner panels 400E are shown as inserting into third channel 238F, it will be appreciated that other orientations of the horizontal form members 202F will be possible. Indeed, depending upon the position of vertical rebar in the wall, it may be necessary to orient some horizontal form members differently so that the interstitial webs 208F do not obstruct the placement of vertical rebar.

In some embodiments, horizontal form members may be laid in place during pouring of the foundation, such that the horizontal form members are embedded by half a flange length in the foundation. The first layer may then be erected by inserting the inner panels 400 and outer panels 300 into the second and fourth channels of the embedded horizontal form member. With this alternative construction method, all the form members used can be of the same length (that being shorter than the inner and outer panels by a flange length). This will further improve on-site efficiency as only one length of form member need be provided, removing the need for on-site cutting or for sorting and selecting the necessary form member length for the given layer of wall.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A concrete form system for constructing a wall comprising:

a plurality of longitudinally spaced-apart form members, each of said form members comprising:
- a vertically upstanding inner post;
- a vertically upstanding outer post, said outer post transversely opposed to said inner post; and
- a plurality of interstitial webs arrayed vertically and extending transversely between said inner post and said outer post, said interstitial webs unitarily formed with the inner post and the outer post, each of said plurality of interstitial webs comprising:
  - a plurality of troughs formed in an upper edge of said interstitial web; and
  - a plurality of ports formed through said interstitial web;

a plurality of rebar retaining members configured to be insertable into and retained by said plurality of ports, wherein each rebar retaining member of said plurality of rebar retaining members comprises:
- a retention clip insertable into one of said plurality of ports;
- an arm connected to said retention clip, said arm extending orthogonally relative to said interstitial web when said retention clip is inserted in one of said plurality of ports thereof; and
- a rebar retaining portion connected to a distal end of said arm, said rebar retaining portion shaped to hold a reinforcing bar in a vertical orientation;

a plurality of outer panels, each of said plurality of outer panels retained between respective outer posts of adjacent form members; and a plurality of inner panels, each of said plurality of inner panels retained between respective inner posts of adjacent form members;

wherein each of said outer posts comprises:
- an interstitial flange;
- an exterior flange, wherein a thickness of said exterior flange corresponds to an air gap distance between said plurality of outer panels and an exterior cladding affixed to said exterior flange; and
- an outer post web extending between said interstitial flange and said exterior flange;
- wherein said interstitial flange, said exterior flange, and said outer post web form first and second vertical channels; and
- wherein each of said plurality of outer panels is retained by a respective first vertical channel and a respective second vertical channel of adjacent form members.

2. The concrete form system of claim 1 wherein each of said outer panels further comprises an exterior layer.

3. The concrete form system of claim 2 wherein said exterior layer is a weather barrier.

4. The concrete form system of claim 1 wherein each of said inner posts comprises:
- an interstitial flange;
- an interior flange; and
- an inner post web extending between said second interstitial flange and said interior flange.

5. The concrete form system of claim 4 wherein said interstitial flange, said interior flange, and said inner post web form first and second vertical channels.

6. The concrete form system of claim 5 wherein each of said plurality of inner panels is retained by a respective first vertical channel and a respective second vertical channel of adjacent form members.

7. The concrete form system of claim 1 wherein said arm comprises an angle bracket, the angle bracket abutting said interstitial web when said retention clip is inserted in one of said plurality of ports thereof.

8. The concrete form system of claim 1 wherein said rebar receiving portion comprises a ring having an opening which faces vertically.

* * * * *